US005462161A

United States Patent [19]

Halaburda et al.

[11] Patent Number: 5,462,161

[45] Date of Patent: Oct. 31, 1995

[54] BATTERY CONTAINER AND DISPLAY PACKAGE

[75] Inventors: Daniel J. Halaburda, Rockaway, N.J.; David Dombrowski, Essex; William H. Valls, Harwinton, both of Conn.

[73] Assignee: Matsushita Electric Corporation of America, Secaucus, N.J.

[21] Appl. No.: 284,263

[22] Filed: Aug. 2, 1994

Related U.S. Application Data

[63] Continuation of Ser. No. 7,172, Jan. 21, 1993, abandoned.

[51] Int. Cl.[6] ..... B65D 73/02

[52] U.S. Cl. ..... 206/705; 206/45.14; 206/470

[58] Field of Search ..... 206/1.5, 45.14, 206/333, 467, 470, 807; 220/4.22, 4.23, 339

[56] References Cited

U.S. PATENT DOCUMENTS

| | | | |
|---|---|---|---|
| 4,139,093 | 2/1979 | Holmes | 220/4.23 |
| 4,234,080 | 11/1980 | Gellert | 220/4.23 |
| 4,378,068 | 3/1983 | Bell | 206/806 |
| 4,381,836 | 5/1983 | Rivkin et al. | 206/45.14 |
| 4,402,423 | 9/1983 | Skowronski et al. | 206/806 |
| 4,424,906 | 1/1984 | Richmond | 206/45.14 |
| 4,637,514 | 1/1987 | Kildea et al. | 220/4.23 |
| 4,732,273 | 3/1988 | DeMarco | 206/470 |
| 5,052,557 | 10/1991 | Contino et al. | 206/470 |

FOREIGN PATENT DOCUMENTS

| | | | |
|---|---|---|---|
| 375925 | 7/1990 | European Pat. Off. | 220/4.22 |

*Primary Examiner*—David T. Fidei
*Attorney, Agent, or Firm*—Amster, Rothstein & Ebenstein

[57] ABSTRACT

A package for the containing and displaying of articles comprising a front panel having at least a first end, a rear panel having at least a first end, and a bottom panel having a first end and a second end. The bottom panel connects the front panel and rear panel. Each of the panels has a first side-channel, and a second side-channel removed from the first side-channel with all of the respective first and second side-channels being longitudinally aligned. A connecting means secures the first end of the rear panel to the front panel.

9 Claims, 4 Drawing Sheets

BATTERY CONTAINER AND DISPLAY PACKAGE

This is a continuation of application Ser. No. 08/007,172 filed on Jan. 21, 1993, now abandoned.

BACKGROUND OF THE INVENTION

The present invention relates to an improved package for holding and displaying batteries.

A great many consumer electronic products require four or more batteries in order to operate. As a result, consumers frequently purchase batteries in large quantities. Therefore, there is a need for a battery package capable of holding four or more batteries in a configuration that is acceptable both to the consumer and retailer. Previously designed packages that hold four or more batteries have faced particular problems.

The battery package should be capable of being displayed by either hanging such package from a rack, or freely standing the package on a surface.

The typical hanging display rack is configured to accept conventional two battery package designs in which the batteries stand vertically in a side-by-side relationship. It is not possible to use this configuration to hold four or more batteries, since the lateral width would be too great to allow side-by-side placement of packages without reconfiguring pre-existing display racks.

It is also preferred for marketing purposes that the batteries be visible through the package when displayed. It is also preferable for the package to be secure yet easily opened.

A number of attempts have been made to address each of these concerns. Examples of such battery packages are disclosed in U.S. Pat. No. 4,896,770 entitled "Battery Display Package" which issued on Jan. 30, 1990; U.S. Pat. No. 4,938,352 entitled "Battery Display Package" which issued on Jul. 3, 1990 and U.S. Pat. No. 5,018,622 entitled "Battery Display Package" which issued on May 28, 1991. The battery package designs of these prior approaches have not fully addressed the problems facing the consumer and the retailer of batteries. Generally, the packages have been too wide or difficult to open.

It is therefore an object of the present invention to provide a package for the display and sale of four or more batteries in a package that may be displayed on a standard hanging rack or free-standing on a surface.

It is a further object of the present invention to provide a package for the display and sale of four or more batteries that is secure yet easily opened by the consumer.

It is still a further object of the present invention to provide a package for the display and sale of four or more batteries in which the batteries are visible to the consumer.

It is still a further object of the present invention to provide a package for the display and sale of four or more batteries including batteries of a "C", "D" or "AA" size.

SUMMARY OF THE INVENTION

The present invention relates to an improved package for batteries. Its unique characteristics allow a retailer to display the package on a standard hanging display rack without the need to reconfigure the display rack. The package is configured to securely hold the batteries in place, while yet being easy for the consumer to open. The configuration also allows the consumer to view the batteries while the batteries are in the package.

The aforementioned problems associated with conventional battery packages are overcome by the present invention comprising a package formed by a front panel having a first end, a rear panel having a first end, and a bottom panel having a first end and a second end. The bottom panel hingedly connects the front panel and rear panel. Each of the panels has a first side-channel and a second side-channel, and the respective side-channels are aligned. In the closed position, the side-channels cooperate to define a space for retaining the articles.

The package is provided with a connecting means that holds the package in a closed position by securing the first end of the rear panel to the front panel. In a preferred embodiment the connecting means has projections extending from an end-wall on the rear panel which projections are inserted in and held by receiving holes in the front panel. This connection means allows for the easy opening of the package. This construction overcomes a problem with certain prior art packages where the front and rear panels of the package are sealed along their entire perimeter thereby making it difficult to open the package. In the preferred embodiment, the first end of the rear panel may be connected to the front panel away from the first end of the front panel to leave available a portion of the front panel to act as a header. Various advertising material may be attached to the header in the fashion of a bill board.

In a preferred embodiment the front panel and rear panel are generally J-shaped in longitudinal cross-section and the bottom panel generally V-shaped in longitudinal cross-section. The bottom panel is hingedly connected to the first side-channel and second side-channel of the front panel and the first side-channel and second side-channel of the rear panel in order to facilitate the closing of the package after the insertion of the batteries. The bottom panel has a substantially flat base in order to allow the package to freely stand on a surface as an alternate method of display.

This configuration allows a consumer to view the batteries through the sides of the package and through the front and rear panels. Of course, even in a configuration where the front panel and rear panel do not have openings the batteries are still visible from the sides of the package.

BRIEF DESCRIPTION OF THE DRAWINGS

The above brief description, as well as further objects and features of the present invention, will be more fully understood by reference to the following detailed description of the presently preferred, albeit illustrative, embodiments of the present invention when taken in conjunction with the accompanying drawing wherein.

DESCRIPTION OF PREFERRED EMBODIMENTS.

Figure 1:
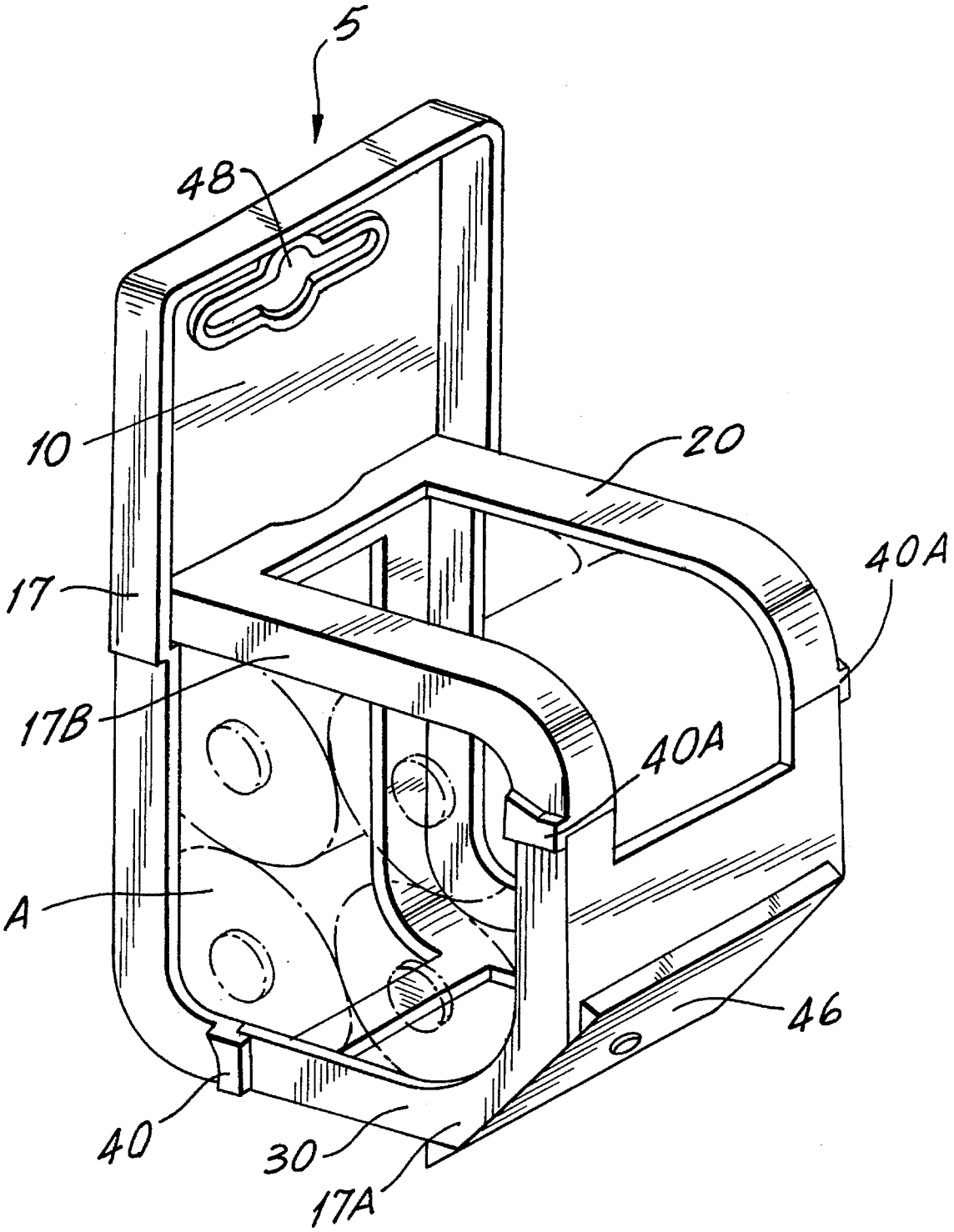
FIG. 1 is an isometric view of the package of the present invention in a closed position.

Referring now to the drawing and in particular to FIG. 1 thereof, a battery package according to the present invention is generally designated by the reference numeral 5. Package 5 is formed by the connections of front panel 10 to bottom panel 30 and of bottom panel 30 to rear panel 20 by means of hinge points 40, 40A. Rear panel 20 is connected to front panel 10 to close package 5 as more fully illustrated below. Batteries A are held securely in place within the interior of package 5. Package 5 may be made using a high density polyethylene or similar material.

Typically, the batteries A will be enclosed by shrink wrap packaging in groups of two. In this fashion, package 5 may be opened by a consumer at the point of sale and discarded with the batteries A still easily carried by virtue of the shrink wrap. If desired or required by law, the packages 5 may then be easily collected and forwarded for recycling by the retailer. In the present embodiment, four batteries are shown, but the batteries may number more or less than four and may be of a variety of sizes including "C", "D" and "AA" sizes.

Figure 2:
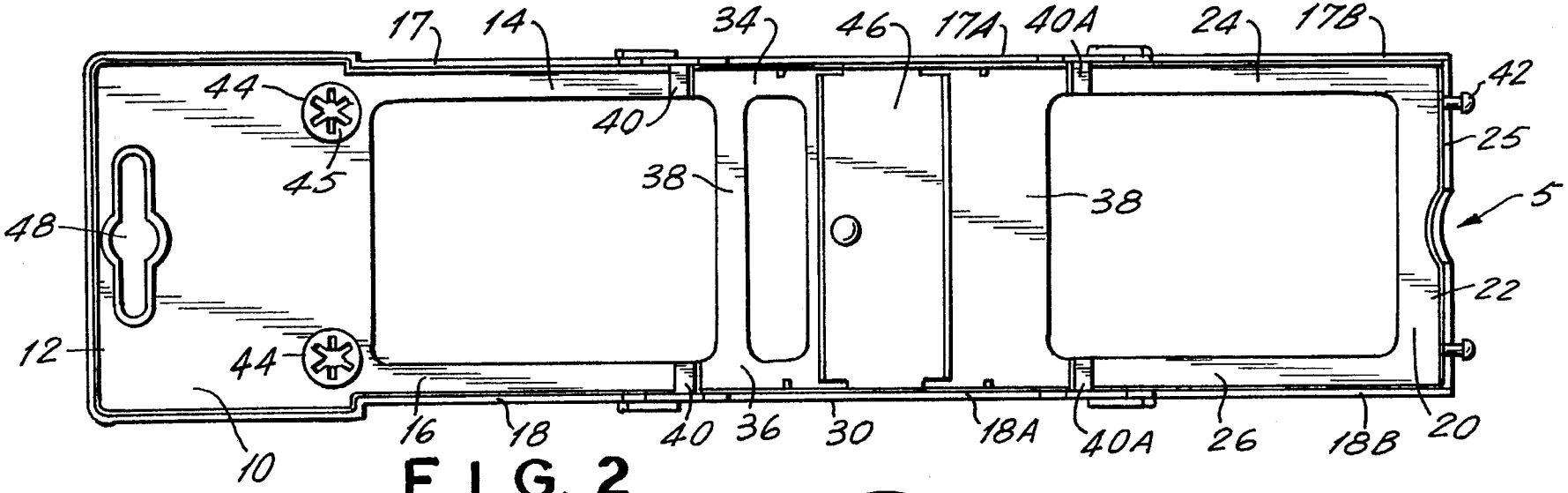
FIG. 2 is a top plan view of the package of the present invention in a fully open position.
Figure 3:
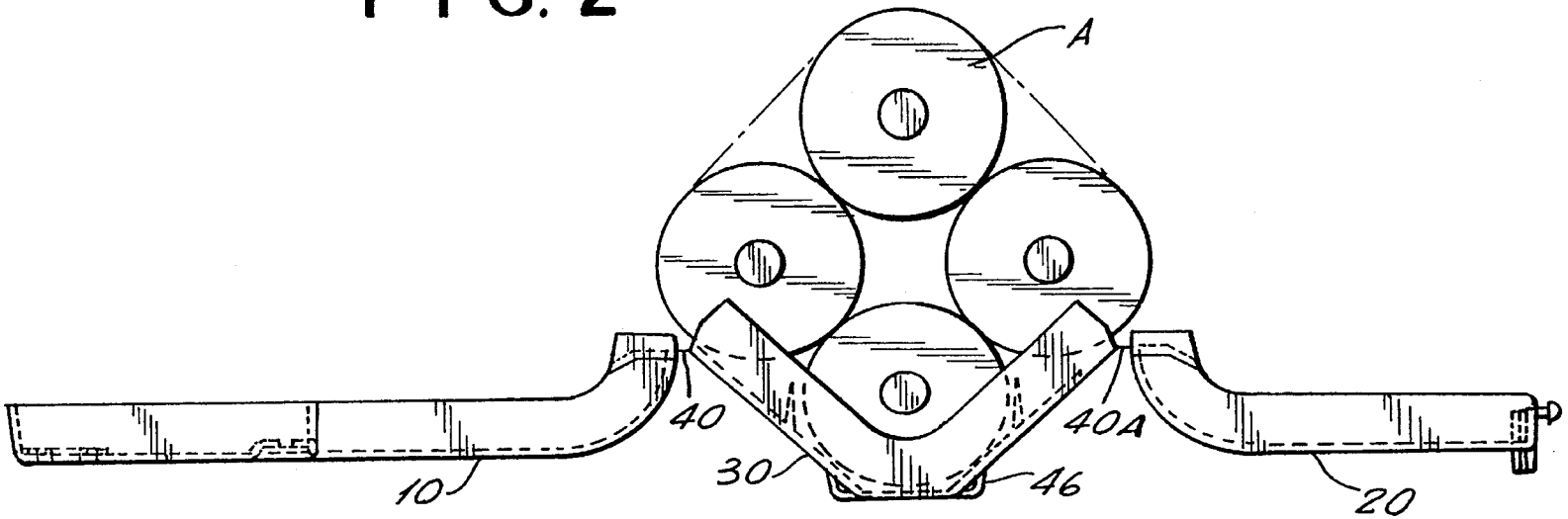
FIG. 3 is a side elevation view of the package of the present invention in a fully open position.

Referring now to FIG. 2 and FIG. 3, package 5 is shown in a fully open position. Front panel 10 and rear panel 20 are generally J-shaped in longitudinal cross section. Bottom panel 30 is generally V-shaped in longitudinal cross-section. As a result, after rear panel 20 is connected to front panel 10 a generally quadrilateral space is formed for holding batteries A. Front panel 10, rear panel 20 and bottom panel 30 may be alternately configured to form a generally quadrilateral enclosure.

Front panel 10 has a transverse first side-wall 17 and a spaced transverse second side-wall 18. The intersection of front panel 10 and first side-wall 17 forms a lip or first side-channel 14. The intersection of front panel 10 and second side-wall 18 forms a lip or second side-channel 16. First side-channel 14 and second side-channel 16 extend, respectively, from side-wall 17 and side-wall 18 until front panel 10 ends at an opening located between side-channel 14 and side-channel 16. Front panel 10 has first end 12 distant from bottom panel 30.

Bottom panel 30 has a transverse first side-wall 17A and a transverse second side-wall 18A. The intersection of bottom panel 30 and first side-wall 17A forms a lip or first side-channel 34. The intersection of bottom panel 30 and second side-wall 18A forms a lip or second side-channel 36. First side-channel 34 and second side-channel 36 extend, respectively, from side-wall 17A and side-wall 18A until bottom panel 30 ends at an opening located between side-channel 34 and side-channel 36. In a preferred embodiment, at least one laterally extending cross member 38 connects first side-channel 34 to second side-channel 36 in order to improve the overall stability of package 5. Additionally, a substantially flat base 46 (see FIG. 3) may be connected between first side-channel 34 and second side-channel 36 in order to provide additional stability, and to provide a base for supporting package 5 when it is placed upon a surface for display.

Rear panel 20 has a transverse first side-wall 17B and a transverse second side-wall 18B. The intersection of rear panel 20 and first side-wall 17B forms a lip or first side-channel 24. The intersection of rear panel 20 and second side-wall 18B forms a lip or second side-channel 26. First side-channel 24 and second side-channel 26 extend, respectively from side-wall 17B and side-wall 18B until rear panel 20 ends at an opening located between side-channel 24 and side-channel 26. Rear panel 20 has first end 22 distant from bottom panel 30.

Bottom panel 30 is connected to first side-channel 14 and second side-channel 16 of front panel 10 by hinges 40, and, in turn, is connected to first side-channel 24 and second side-channel 26 of rear panel 20 by hinges 40A. In this fashion, front panel 10 and rear panel 20 may easily be moved to connect and close package 5.

Figure 4:
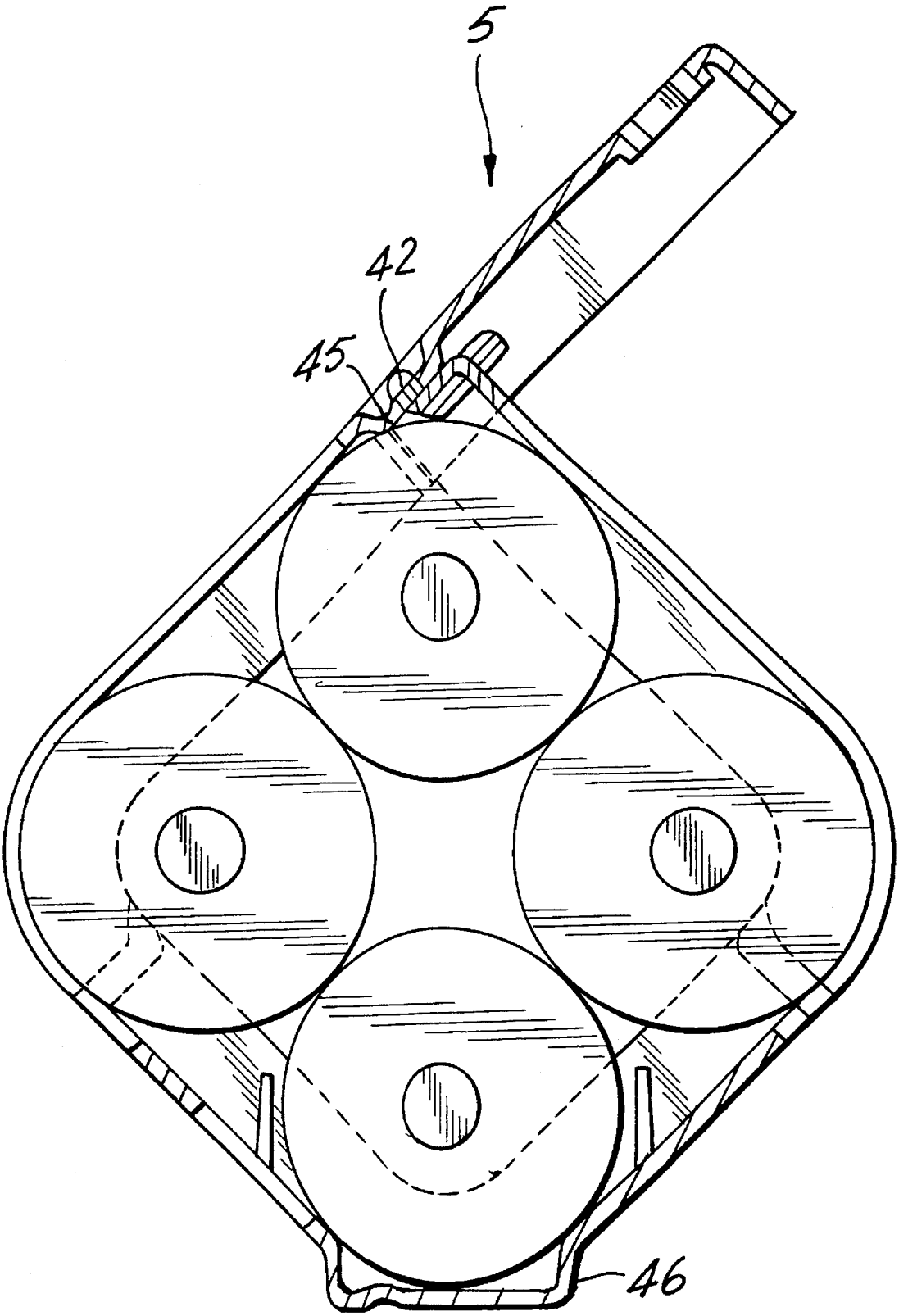
FIG. 4 is a side elevation view of the package of the present invention in a closed position.

The preferred connecting means for securing rear panel 20 to front panel 10 will now be explained by FIGS. 2, 3 and 4. As illustrated in FIG. 2, rear panel 20 has transverse end-wall 25 with projections 42. Front panel 10 has receiving holes 44 which are dimensioned and aligned to receive projection 42. To close the package, panels 10, 20 and 30 are folded at hinges 40, 40A and projections 42 .are inserted through receiving holes 44 with projections 42 being retained in place by flexible extensions 45 located within receiving holes 44. As may be seen, the several pairs of side-channels 14, 16, 34, 36, 24, 26 are longitudinally aligned and cooperate in the closed position to form a retaining space for receiving and retaining the batteries in place. If desired, receiving holes 44 may be placed at a distance away from first end 12 in order to leave a portion of front panel 10 to act as a header or bill-board for advertising materials. A benefit of using this type of connecting means is that package 5 may be reclosed after being opened. The opening of previously designed battery packages resulted in the destruction of the connecting means.

Other connecting means may instead be used such as adhesively bonding front panel 10 and rear panel 20, or utilizing any other male/female mechanical connector. Slot 48 is provided in order to allow package 5 to be hung from a display rack rod.

Figure 5:
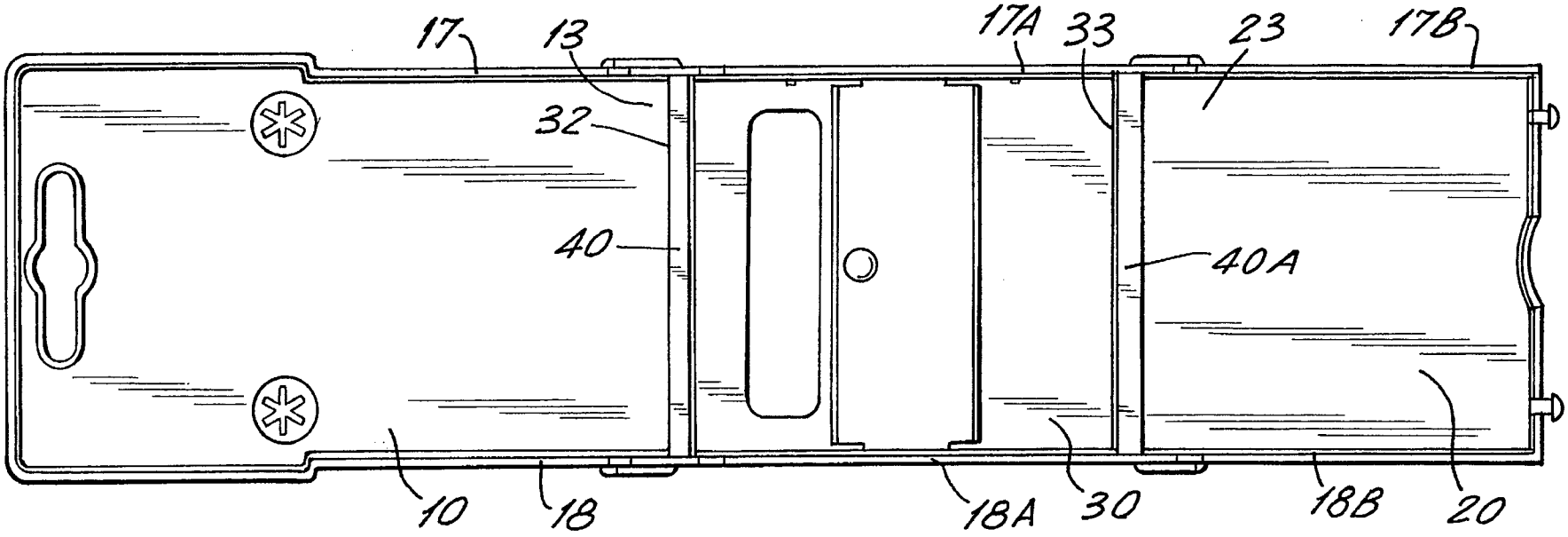
FIG. 5 is a top plan view similar to FIG. 2, but showing an alternative embodiment of the package of the present invention.

In an alternate embodiment, and referring to FIG. 5, front panel 10 does not contain an opening between first side-wall 17 and second side-wall 18 and rear panel 20 does not contain an opening between first side-wall 17B and second side-wall 18B. Front panel 10 has a second end 13 proximate bottom panel 30, and rear panel 20 has a second end 23 proximate bottom panel 30. Bottom panel 30 has a first end 32 and a second end 33. In this configuration, batteries A cannot be viewed through front panel 10 and rear panel 20, but can still be viewed from the sides of package 5. Hinges 40, 40A may also extend from first side-walls 17, 17B through to second side-walls 18, 18B.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein.

We claim:

1. A package for the containing and displaying of articles comprising a long front panel having a generally J-shaped cross-section and having a first end, and a second end, a short rear panel having a generally J-shaped cross-section and having at least .a first end, a bottom panel having a generally V-shaped cross-section and having a first end and a second end, said bottom panel connecting said front panel and rear panel, each of said panels having a first side-channel, and a second side-channel removed from said first side-channel, all of the respective first and second side-channels being longitudinally aligned, such that said respective first side-channels define an opening along a side of said package, and said second side-channels define an opening along the opposite side of said package, and a connecting means for securing the first end of said rear panel to said front panel at a position intermediate the first end and the second end of said front panel.

2. The package of claim 1, wherein said bottom panel is hingedly connected to said first side-channel and said second side-channel of said front panel and said first side-channel and said second side-channel of said rear panel.

3. The package of claim 2, wherein said front panel has a slot for hanging said package from a display rod.

4. The package of claim 1, wherein said bottom panel is hingedly connected to said second end of said front panel and said second end of said rear panel.

5. The package of claim 4 wherein said front panel has a slot for hanging said package from a display rod.

6. The package of claim 1, wherein said bottom panel has a substantially flat base.

7. The package of claim 1, wherein said connecting means comprises an end-wall extending from said first end of said rear panel, projections extending from said end-wall and receiving holes in said front panel for securing said projections when said projections are inserted in said receiving holes.

8. The package of claim 1, wherein said articles are enclosed in shrink wrap.

9. The package of claim 1, wherein said rear panel is secured to said front panel at approximately the middle portion of said front panel.

* * * * *